United States Patent [19]

Blomsma

[11] 4,134,461

[45] Jan. 16, 1979

[54] MARINE STRUCTURE AND METHOD OF DRILLING A HOLE BY MEANS OF SAID STRUCTURE

[75] Inventor: Everhard C. Blomsma, Rijswijk, Netherlands

[73] Assignee: Shell Oil Company, Houston, Tex.

[21] Appl. No.: 821,059

[22] Filed: Aug. 1, 1977

[30] Foreign Application Priority Data

Aug. 4, 1976 [GB] United Kingdom ..... 32501/76

[51] Int. Cl.[2] ..... E21B 15/02; E21B 7/18

[52] U.S. Cl. ..... 175/9; 175/72; 166/335; 175/66

[58] Field of Search ..... 175/5–10, 175/72, 66; 166/0.5; 61/87, 88, 101; 137/236

[56] References Cited

U.S. PATENT DOCUMENTS

| | | | |
|---|---|---|---|
| 2,482,788 | 9/1949 | Moon | 175/9 X |
| 2,684,575 | 7/1954 | Pryor et al. | 175/8 X |
| 2,923,531 | 2/1960 | Bauer et al. | 175/7 |
| 3,603,409 | 9/1971 | Watkins | 175/7 |
| 3,657,895 | 4/1972 | Phelps | 61/86 |
| 4,063,602 | 11/1976 | Howell et al. | 175/7 |

*Primary Examiner*—Ernest R. Purser
*Assistant Examiner*—Richard E. Favreau

[57] ABSTRACT

A bottom-positioned well drilling platform is provided with an enclosure in the lower part thereof which forms a chamber into which returning drilling mud and cuttings can be discharged. A pump and separate return line raise the mud alone from the chamber to the top of the platform while the cuttings remain in the chamber.

8 Claims, 1 Drawing Figure

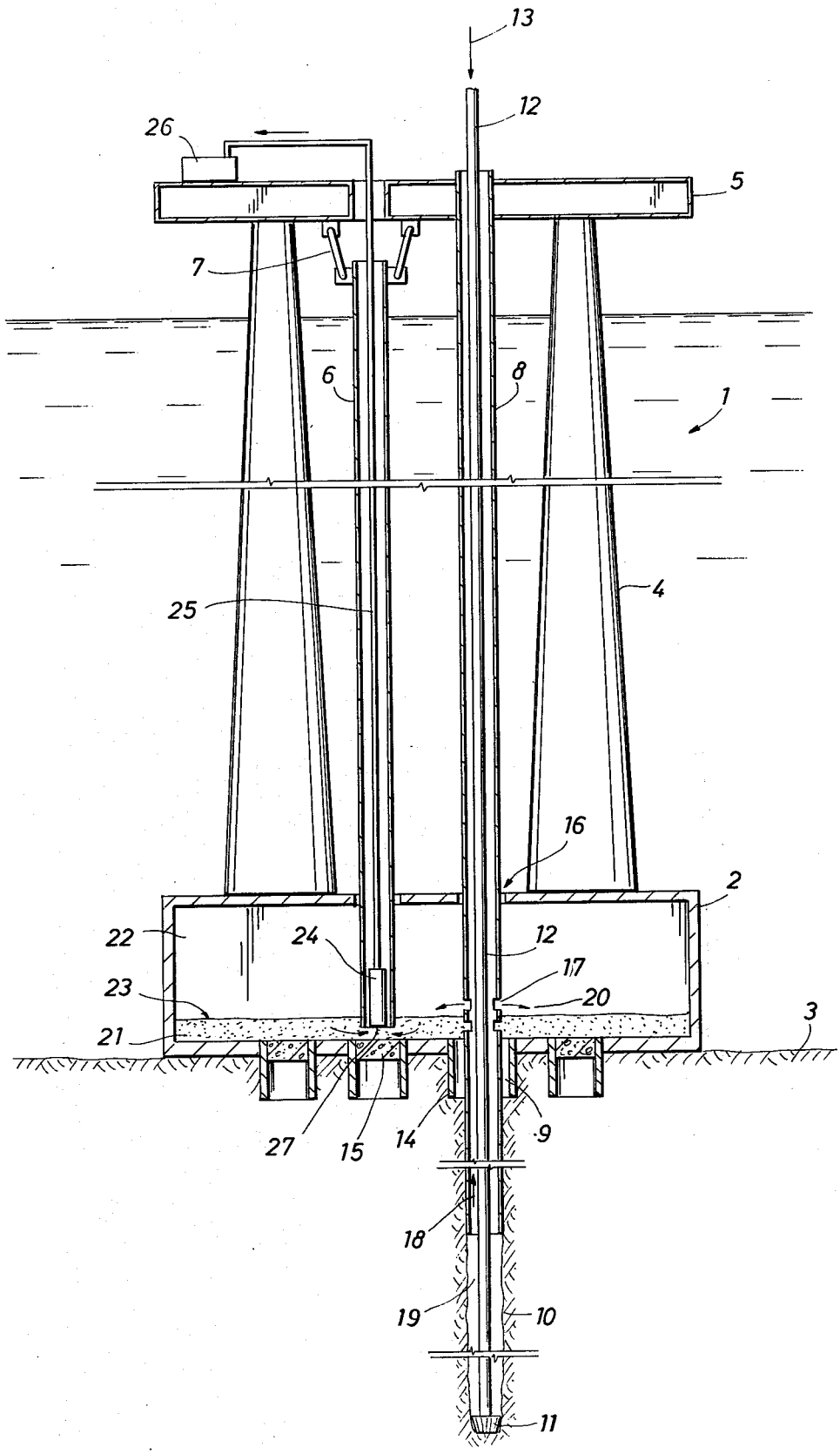
13
12
26
5
7
6
8
1
4
25
16
2
22
24
12
17
23
20
21
3
27
15
14
9
18
19
10
11

MARINE STRUCTURE AND METHOD OF DRILLING A HOLE BY MEANS OF SAID STRUCTURE

BACKGROUND OF THE INVENTION

The invention relates to a marine structure that is adapted for being positioned on the bottom of a body of water, such as the sea bottom or ocean bottom.

The invention relates in particular to a marine structure that is designed for carrying out drilling operations in the marine bottom, such as for drilling boreholes into oil and/or gas containing subsurface formations. For this purpose, such structure includes a drilling platform and at least one conductor pipe at least extending between the platform and the bottom part of the structure.

The present invention further relates to a method of drilling a hole by means of such a marine structure.

Conductor pipes in marine structures are applied to form a communication between the wellhead on the platform and the hole that is being drilled in the marine bottom. These conductor pipes are of large diameter (say 30 inches) and are applied during spudding-in of the well as a means for guiding the drill bit and drill string down to the marine bottom, and as a means through which the drilling fluid is returned to the platform. In the later stages of the drilling operations, casing is suspended in the conductor pipe.

In drilling operations taking place in deep water it has been found that a close control should be carried out on the density of the mud that is being applied, in particular during the initial drilling period of the hole, that is the period prior to setting the first casing. The density of the mud should be kept sufficiently low to prevent the pressure exerted in the open hole by the weight of the return mud column to grow larger than the fracturing pressure of the formation around the open hole. Reduction of the density of the mud may be accomplished by reducing the solid content thereof. This, however, may influence the sealing properties of the mud adversely and should be avoided when drilling in formations with high permeability.

Object of the invention is a marine structure comprising means that allow the application of a relatively low mud pressure in the hole that is being drilled.

SUMMARY OF THE INVENTION

The marine structure according to the invention includes a drilling platform and at least one conductor pipe at least extending between the platform and the bottom part of the structure, said conductor pipe comprising openings in the wall thereof, which openings communicate with an underwater chamber forming part of the structure preferably near the lower end thereof, and pumping means having the suction side thereof in communication with said chamber, the outlet of said pumping means being outside the underwater chamber.

The outlet of the pumping means may communicate with a level situated near the level of the drilling platform above the surface of the water.

The marine structure may include a plurality of conductor pipes, one of these conductor pipes housing the pumping means and being in communication with the underwater chamber.

The method of drilling a hole by means of the marine structure of the invention includes the steps of passing return mud with cuttings, during at least part of the initial drilling period of the hole prior to setting the first casing therein, through the openings in the wall of the conductor pipe into the underwater chamber, and lifting at least part of the mud without cuttings from the underwater chamber to a level above sea level by the pumping means to maintain a mud/seawater separation level in the underwater chamber.

The method of drilling holes by means of the marine structure of the invention includes the steps of passing return mud during the drilling period preceding the setting of the first casing in the last hole that is being drilled, through the openings in the wall of the conductor pipe co-operating with this last hole, and collecting the mud in the underwater chamber for storage near the ocean floor so as to reduce the hydrostatic head of fluid in the well below a level at which fracturing of the formation around the said last hole would occur.

BRIEF DESCRIPTION OF THE DRAWING

The invention will be described by way of example in more detail with reference to the schematic drawing which shows a longitudinal section of the marine platform of the invention.

DESCRIPTION OF A PREFERRED EMBODIMENT

The marine structure 1, shown by way of example in the drawing, is a so-called gravity type structure which includes a base 2 of reinforced concrete which rests on the sea bottom 3. The base 2 is hollow forming a chamber therein. The top of the base 2 supports a plurality of columns or towers 4 of reinforced concrete. A platform or deck 5 is situated on top of these towers, this deck carrying all equipment that is necessary for carrying out the desired drilling operations. Only one component of this equipment is shown in the drawing.

A plurality of conductor pipes extends between the hollow base 2 and the deck 5 of the marine structure 1. Two of these conductor pipes are shown. The first conductor pipe 6 is carried by the deck 5 by hanger means 7 and the open lower end of this conductor pipe 6 is above the bottom of the chamber formed in the hollow base 2 of the marine structure 1. The second conductor pipe 8 is arranged with the lower end thereof extending through an opening 9 in the bottom wall of the hollow base 2, and may extend a distance of several tens of meters into the sea bottom 3. The lower end of the conductor pipe 8 may be cemented in the sea bottom 3 in a manner known to the art. A borehole 10 has been drilled in the sea bottom 3 below the second conductor pipe 8 by means of a drill bit 11 supported at the lower end of a drill string 12 that is operated from the deck 5 in a manner known to the art. During such drilling operations, mud is being pumped down through the interior of the drill string 12 in the direction of arrow 13.

The opening 9 provided in the bottom wall of the base 2 may be lined with a short length of a metal tube 14 which extends into the sea bottom 3. A plurality of such tubes 14 are arranged in the bottom wall of the base 2. The passage through each of these tubes is originally plugged by a cement plug 15 to preserve the buoyancy of the base 2 during oversea transport of the marine structure 1 to its location. After the structure has been lowered on the sea bottom 3, the plugs 15 are removed (such as by drilling) to allow a conductor pipe (such as 6 or 8) to pass through each opening 9. The annular space between the tube 14 and the conductor may be plugged off prior to drilling the hole 10.

The conductor pipes pass through the upper wall of the base 2 through openings 16 arranged therein. If desired, the space between the outer wall of each conductor pipe and the inner wall of the relevant opening 16 may be sealed by suitable means (not shown) or cement. In such a case, however, provisions would have to be made to bring the interior of the base 2 into communication with the sea at a place other than the sealed openings 9.

The conductor pipe 8 has a plurality of openings 17 arranged in the wall thereof in a region that is inside the base 2 in communication with the chamber therein. Mud that is being pumped through the hole 10 during the drilling operation is allowed to escape through these openings 17 when returning (see arrow 18) through the annular space 19 around the drill string 12. The mud flows out of the openings 17 (see arrows 20) and is collected in the lower part of the interior of the base 2. The mud volume 21 in the base 2 is kept separated from the sea water 22 present in the interior of the base 2 by the difference in density existing between the two fluids. The interior of the base 2 thus forms an underwater chamber containing sea water and mud with earth cuttings. The pressure at the mud/water interface is dictated by the distance between this interface and the sea level.

As has been observed hereinabove, the open lower end of the conductor pipe 6 is situated above the bottom wall of the base 2. As shown in the drawing, this open end is below the mud/sea water interface 23. A pump 24 is arranged in the marine conductor 6, which pump has its suction end 27 in free communication with the mud volume 21, and is coupled with its outlet to the tube 25 extending upwards through the conductor 6 to the level of the deck 5. The end of the tube 25 communicates with a vessel 26, which forms part of a system (not shown) wherein the mud can be conditioned for re-use.

Before initiating drilling operations, the cement plug present in the tube 14 is removed, and the conductor pipe 8 is lowered through opening 9 in a manner known to the art until the lower end of the conductor 8 has penetrated a sufficient depth into the sea bottom 3. If necessary, the lower end of the conductor pipe 8 may be cemented, and the annular space in the tube 14 may be sealed off, such as by cement.

Subsequently, the bit 11 and the drill string 12 are lowered through the conductor pipe 8 and drilling of the hole 10 is initiated by axially loading the bit and rotating the drill string 12. Drilling mud is simultaneously being supplied and pumped (see arrow 13) through the drill string 12, with the return mud flow (see arrow 18) passing upwardly through the annulus 19 between the wall of the open hole 10 or pipe 8 and the drill string 12, to escape from the annulus 19 through openings 17 in pipe 8 to the interior of the base 2, where it is collected in the lower part thereof to form the volume of mud 21.

It will be appreciated that the pressure in the open hole 10 is dictated by the height of the liquid column extending upwards therefrom. By applying the method and apparatus of the present invention, the liquid column extending between the deck 5 and the upper end of the hole 10 is for the greater part thereof formed by a column of sea water. Since the density of the sea water is appreciably lower than that of the mud, it will be clear that compared to the situation wherein the return mud would flow to the level of the deck 5 through the annulus existing between the conductor 8 and the drill string 12, a considerable reduction of the pressure prevailing in the hole 10 is obtained. Hereby, the pressure in the open hole 10 is reduced to a value lower than the value of the formation fracturing pressure, and drilling of the hole 10 can proceed without the risk of fracturing the formation layers below the sea bottom 3 with resultant loss of the drilling mud into the fractured formation.

The mud that is being collected in the interior of the base 2, is transported to the deck 5 by means of the pump 24 situated in the conductor pipe 6. The pump 24, which may be of any type suitable for the purpose, displaces the mud through the outlet or discharge tube 25 to the tank 26. Subsequently, the returned mud may be treated for re-use.

It will be appreciated that the pump 24 is not necessarily suspended in the conductor pipe 6. If desired, the pump may be suspended from the tube 25. The tube 25 having the pump 24 suspended therefrom is then lowered until the pump enters the interior of the base 2 through a suitable opening (not shown) in the upper wall thereof. However, the conductor pipe 6 that extends over a height of 100 to 200 meters is an attractive guide means for lowering the pump and therefore preferably used for the purpose described.

The conductor pipe 6 may be suspended from the deck 5 in any suitable manner. After the drilling operations through the conductor pipes other than the conductor pipe 8 have been finished, the plug below the conductor pipe 6 is removed. The conductor pipe 6 or one similar to pipe 8 is then lowered partly into the sea bottom 3 to a desired level below the sea bottom. The lower end of the conductor pipe is lowered in the sea bottom by any means suitable for the purpose (such as by means of hydraulic jet nozzles). If openings corresponding to openings 17 in conductor pipe 8 are already present in the wall of conductor pipe 6, this conductor pipe 6 is lowered to a depth at which the said corresponding openings (not shown) are at the level just above the bottom wall of the base 2. If such openings are not yet present in the conductor pipe 6, they are made therein (in any suitable manner), such as when the conductor pipe 6 is in its final position. Drilling is thereafter initiated in the manner described with reference to the hole 10. The return mud is passed through the (not shown) openings in the wall of the conductor pipe 6, and collected in the underwater chamber formed by the interior of the base 2, and either removed therefrom by (not shown) pumping means, or left therein. It will be appreciated that the dimensions of the base 2 are often extremely large and that the volume of the underwater chamber (which is constituted by the base 2 or forms a part thereof) is sufficiently large for storing the mud used in the initial drilling period of the last hole (that is the drilling period preceding the setting of the first casing in said hole) below a level at which fracturing of the formation around said last hole would occur.

Any type of pump 24 suitable for the purpose, may be used.

The conductor pipe 6 may, if desired, be arranged to have the open upper end thereof in communication with the tank 26. The pump 24 and the tube 25 can then be omitted, and the mud may be lifted from the mud volume 21 by passing compressed air into the lower part of said conductor pipe 6, thereby air-lifting the return mud to the level of the deck 5.

All conductor pipes or a part thereof may be situated in the towers or columns 4 instead of outside these towers as shown in the drawing. The towers may be made of steel instead of concrete as described with reference to the example shown in the drawing. The latter also applies to the base 2, which base may be of any desired configuration.

In another embodiment of the invention, the conductor pipe housing the pump for lifting the return mud, is arranged in the same position as the conductor pipe 8 (see the position thereof shown in the drawing). The return mud collected in the lower part of the interior of the base then flows through openings present in the wall of the said conductor pipe towards the pump suspended therein, and is subsequently lifted to the deck of the marine structure.

It will be appreciated that the desired reduction of the pressure prevailing in the borehole 10 can only be reached by application of the present invention during the initial drilling period of the hole, that is the period preceding the setting of the first casing in the hole. By setting the first casing, which is suspended in a known manner from the top end of the conductor, the communication between the open hole 10 and the openings 17 is broken. Consequently, on resuming the drilling operation, the return mud cannot flow to the underwater chamber in the base 2, but flows to the deck 5 through the annulus between the drill string and the said casing. Therefore, the first casing should be set at a depth at which the chances of formation fracturing by the pressure of the column of return mud are small.

I claim as my invention:

1. Marine structure adapted for being positioned on the bottom of a body of water and extending upward above the surface thereof, said structure comprising a drilling platform having a laterally-extensive hollow base and at least one conductor pipe, at least extending between the top of the platform and the chamber formed in the hollow base of the structure, said conductor pipe being provided with openings in the wall thereof, which openings communicate with an underwater chamber forming part of the structure, and pumping means having the suction side thereof in communication with said chamber, the outlet of said pumping means being outside the underwater chamber.

2. Marine structure according to claim 1, including a discharge line extending from said outlet of said pumping means to a point above the body of water whereby the outlet of the pumping means communicates with a level situated near the level of the drilling platform.

3. Marine structure according to claim 1 wherein the pumping means consists of an air lift pump.

4. Marine structure according to claim 1 including a plurality of conductor pipes, one of these conductor pipes housing the pumping means and being in communication with the underwater chamber.

5. Marine structure according to claim 4, wherein the conductor pipe housing the pumping means communicates with the underwater chamber through at least one opening arranged in the conductor pipe.

6. Marine structure according to claim 4, wherein the conductor pipe housing the pumping means is supported at its upper end such that its lower end is free from the bottom of the underwater chamber.

7. Method of drilling a hole through a conductor pipe extending through a marine structure having a hollow base with a chamber formed therein around openings in conductor pipe while circulating a drilling mud down the hole and returning mud to the surface, said method including the steps of passing returning mud – during at least part of the initial drilling period of the hole – through the openings in the wall of the conductor pipe into the underwater chamber, and lifting at least part of the mud from the underwater chamber to a level above sea level by the pumping means to maintain a mud/sea water separation level in the underwater chamber.

8. Method of drilling holes by means of the marine structure according to claim 7, said method including the steps of passing return mud during the drilling period preceding the setting of a first casing, through the openings in the wall of the conductor pipe, and collecting the mud in the underwater chamber for storage below a pressure level at which fracturing of the formation around the hole would occur.

* * * * *